US006235127B1

(12) United States Patent
Rader et al.

(10) Patent No.: US 6,235,127 B1
(45) Date of Patent: May 22, 2001

(54) METHOD OF MAKING A TOILET BOWL CLEANING TABLET

(75) Inventors: James E. Rader, Pleasanton; Erika W. Feller, Oakland; Rachel A. Watson-Clark, Fremont, all of CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/392,872

(22) Filed: Sep. 9, 1999

Related U.S. Application Data

(60) Provisional application No. 60/100,206, filed on Sep. 14, 1998.

(51) Int. Cl.[7] ..... B08B 7/00

(52) U.S. Cl. ..... 134/42; 510/191; 510/192; 510/446; 134/34

(58) Field of Search ..... 510/191, 192, 510/495, 445, 446, 447; 134/34, 42

(56) References Cited

U.S. PATENT DOCUMENTS 4,043,931 * 8/1977 Jeffrey et al. .
4,460,490 * 7/1984 Barford et al. .
5,945,390 * 8/1999 Jeffrey et al. .
5,990,061 * 11/1999 Veltman et al. .
6,001,789 * 12/1999 Trinh et al. .

* cited by examiner

*Primary Examiner*—Necholus Ogden
(74) *Attorney, Agent, or Firm*—Michael J. Mazza

(57) ABSTRACT

A cleaning formulation, in tablet form, capable of providing uniform delivery of cleaning agents, fragrance and colorant while immersed in a the tank of a toilet. The tablet comprises a solubility-controlling matrix of a linear alkyl benzene sulfonate, and an alkyl sulfate surfactants, a monoalkanolamide dissolution control agent, a hydroxyethylcellulose binder; and cleaning actives including a peroxygen bleach, organic and inorganic salts, and aesthetic agents to signal ongoing cleaning effectiveness

1 Claim, No Drawings

METHOD OF MAKING A TOILET BOWL CLEANING TABLET

CROSS REFERENCE TO RELATED APPLICATIONS

This application claims priority of U.S. provisional application Serial No. 60/100,206, filed Sep. 14, 1998.

FIELD OF THE INVENTION

This invention relates to formulations for cleaning toilet bowls, and in particular to a composite in-tank toilet tablet providing uniform release of all ingredients.

BACKGROUND OF THE INVENTION

There are numerous compositions known to the art which can be compressed or tableted, providing a tablet, block or similar article which may be placed in the tank of a toilet and dispense cleaning active over a period of time. Such tablets may consist of, or include various cleaning agents such as bleaches, surfactants, disinfectants, and mixtures thereof. Menke, et al., U.S. Pat. No. 4,820,449 describes a toilet bowl cleaning block comprising 10 to 30% of a mono-alkyl sulfate salt, 5 to 40% of an alkanolamide, and 15 to 60% of a water-soluble inorganic alkali salt. Holdt, et al., U.S. Pat. No. 4,683,072 discloses a two-component, extruded cleaner and disinfectant tablet, comprising an LAS, an inorganic alkali metal salt such as carbonate, a plasticizer, an ethanolamide and an acidic or peroxy disinfecting agent, in combination with an LAS, plasticizer, and ethanolamide. U.S. Pat. No. 4,362,639 to Eoga claims a composition having an oxidizing agent (which may be a monopersulfate salt) a bleach promoter, a perborate salt and ammonium ion source. The bleach promoter is an alkali metal or alkaline earth metal halide, and the ammonium source is preferably an ammonium chloride, sulfate, citrate, or phosphate. Walker, et al., U.S. Pat. No. 4,741,853 discloses a solid cleaning block containing at least 60% of an alkali metal monopersulfate and the remainder an alkaline earth metal salt of a $C_{12}$–$C_{24}$ fatty acid. Hung, U.S. Pat. Nos. 4,536,368 and 4,536,367 both teach a method of delivering a sanitizing agent such as a perborate, percarbonate, peroxide and persulfate in conjunction with a triphenylmethane indicator dye. Barford, U.S. Pat. No. 4,460,490 describes a shaped block having a slow-dissolving cleaning composition and a secondary tablet incorporating a bleaching agent. Monoalkyl sulfate and monoalkyl amide and hydroxymethylcellulose based cleaning tablets are disclosed for various uses, in U.S. Pat. No. 4,722,802, to Hutchings.

One of the difficulties which toilet bowl cleaning tablets of the art has been establishing a uniform release of active over a commercially feasible term (for example up to three months) and further to ensure substantially all of the tablet components dissolve at the same rate and with substantially the same endpoint. With particular reference to prior art, toilet bowl tablets which have a color and/or fragrance to indicate that the tablet continues to possess cleaning efficacy, the color and/or fragrance generally become imperceptible before the tablet is fully dissolved, and a residue typically remains in the tank, after the consumer believes the table has been fully used up. Furthermore, floating residue from an undissolved cleaning tablet in the toilet tank can contaminant toilet tank trim parts such as the flapper, water valve and overflow tube.

Accordingly, it is an object of the present invention to provide a composite tablet having improved dissolution of the total tablet to avoid the appearance of residue.

It is another an object of the present invention to provide a composite tablet having a long useful life.

It is another object of the present invention to provide a composite tablet having consistent cleaning performance over its useful life.

It is another object of the present invention to provide a composition that controls manufacturing and chemical costs by minimizing cost of ingredients needed to provide consumer aesthetic and cleaning performance benefits.

SUMMARY OF THE INVENTION

The present invention is a cleaning formulation, in tablet form, capable of providing a metered, uniform and complete release of cleaning active while immersed in the tank of a toilet. The present invention provides improved dissolution of the total tablet to avoid residue remaining, especially in formulations having a consumer-perceptible signal, e.g., a color and/or fragrance.

An article of the present invention comprises a matrix consisting of a binder, at least two surfactants and a dissolution control agent. The matrix serves to control dissolution of the active cleaning materials and aesthetic agents, such as a colorant and/or fragrance. A preferred tablet formulation accordingly comprises a matrix of an alkyaryl or alkyl sulfonate surfactant, an alkyl sulfate surfactant, a $C_{12-18}$ alkanolamide dissolution control agent and a hydroxyalkyl cellulose binder. The tablet additionally includes an aesthetic agent, which may be a fragrance or a water-soluble colorant, a peroxygen bleaching agent, and inorganic salt and organic salts.

DETAILED DESCRIPTION OF THE INVENTION

The toilet cleaning block of the present invention is a generally homogenous composite solid comprising a matrix of at least two surfactants, a dissolution control agent and a binder. Contained within and/or supported by the matrix is a bleaching agent, organic and inorganic salts and an aesthetic agent such as a colorant and/or fragrance. A preferred formulation of the tablet of the present invention comprises a matrix about 3% to 30% $C_{10-14}$ linear alkyl (aryl) sulfonate, about 3% to 15% $C_{10-14}$ alkyl sulfate, about 2% to 15% $C_{12-18}$ alkanolamide, about 5% to 25% hydroxyalkylcellulose, about 0% to 20% peroxygen bleach, about 0.1% to 15% aesthetic agent, and about 0%–75% organic and inorganic salts which act as electrolyte/buffers and/or cleaning aids. Unless otherwise stated, or implied from context, all amounts are in weight percent.

Surprisingly, it was discovered that by controlling the levels and ratios of alkyl sulfate, alkyl amide, hydroxyalkylcellulose and alkyl (aryl) sulfonate, the dissolution rate of the cleaning block can be controlled to uniformly meter all components over a predefined period, up to about 12 weeks. The most preferred formula ranges of the important matrix-forming ingredients are about 5% to 10% $C_{10-14}$ alkyl sulfate, about 5% to 12% $C_{12-18}$ alkanolamide, about 10% to 15% hydroxyethylcelluose and about 5% to 20% linear alkyl benzene sulfonate. The most preferred formula ranges of the matrix-forning ingredients are about 7% to 9% $C_{10-14}$ alkyl sulfate, about 7% to 11% $C_{12-18}$ alkanolamide, about 12% to 14% hydroxyethylcelluose and about 10% to 15% linear alkyl benzene sulfonate. Such formula ranges for these ingredients will yield an in-tank toilet bowl cleaning block or tablet having a dissolution rate of between about 0.05–0.07 g/flush, preferably between about 0.055–0.065 g/flush. When formed into a tablet or block, it will deliver uniform cleaning and aesthetic efficacy for up to about 12 weeks; or, at about 12 flushes per day will provide cleaning and aesthetic efficacy for about 1080 flushes, and will be completely dissolved at the end of its useful life, leaving essentially no residue in the tank.

FORMULATION EXAMPLE I

| Ingredient | Weight Percent |
|---|---|
| Linear alkyl benzene sulfonate | 12.0 |
| Sodium laurly sulfonate | 9.0 |
| CMA (Monoalkanolamide) | 9–11.5 |
| Na-carbonate | 10.0 |
| Na-citrate (dihydrate) | 9.5–12 |
| Potassium Monopersulfate | 7.0 |
| Fragrance/silica | 15.0 |
| Blue Dye | 11.0 |
| Hydroxyethylcellulose | 15.0 |

SURFACTANTS

Two surfactants are preferably combined for cleaning-effectiveness and dissolution rate control. The alkyl (aryl) sulfonate cooperates with the dissolution control and binder to form a structured matrix with a degree of hydrophobicity which contributes to the desired controlled slow dissolution, and uniform release in water. The alkyl or aryl sulfate, a hydrotrope, functions to help dissolve the matrix, releasing the aesthetic agents and cleaning actives.

The most preferred sulfonate surfactants are linear $C_{12}$ alkyl benzene sulfonates or alkali-metal $C_{13-17}$ alkane sulfonates, such as Hostapur SAS-93. The most preferred sulfate surfactants are alkali metal lauryl or alkali metal aryl sulfates, especially sodium lauryl sulfate, and sodium xylene sulfate. Surfactants are present in a total amount of about 5% to 45% preferably about 10 to 30%.

BUFFER/ELECTROLYTES

According to the present invention, suitable electrolytes/buffers may be selected from the group consisting of carbonates, phosphates, pyrophosphates, amino carboxylates, polycarboxylates, polyacrylates, phosphonates, amino phosphonates, polyphosphonates, citrates salt thereof, and mixtures thereof. The electrolyte/buffer is present in an amount from 0 to about 30 weight percent. Most preferred is a sodium carbonate electrolyte/buffer combined with a sodium citrate, the latter of which also acts to provide cleaning and sanitizing efficacy.

DISSOLUTION CONTROL AGENT

A dissolution control aid provides a degree of hydrophobicity to the matrix, thus contributing to the slow, uniform release of actives. Preferred are mono- or di-alkanol amides derived from $C_{12-14}$ fatty acids, and having a $C_{2-6}$ (mono- or di-) amine group. Most preferred is a cocomonoethanolamide (CMA) such as that sold under the tradename cocamide MEA, sold by Mona Industries, Inc. The dissolution control agent is present in an amount from about 2 to 20 percent, preferably 5 to 15 percent.

BINDER

The binder contributes to the structural integrity of the matrix and is preferably a hydroxyethylcellulose or hydroxymethyl cellulose having a molecular weight of between about 300,000 to 900,000 g/mole, preferably about 400,000 to 800,000 g/mole. Most preferred is a hydroxyethyl cellulose such as Union Carbide's Cellosize HEC, having a molecular weight of 750,000 g/mole. The binder is present in the amount of from about 5 to 25 percent.

BLEACHING AGENT

Suitable peroxygen bleaching agents are water-soluble monopersulfates and water-soluble monoperphosphates. Preferred peroxygen bleaching agents include sodium monopersulfates, potassium monopersulfate, disodium monoperphosphate and dipotassium monoperphosphate. A particularly preferred peroxygen bleaching agent for compositions of the present invention is potassium monopersulfate which is commercially available from E.I. duPont de Nemours under the trade name "Oxone" ($2KHSO_5.KHSO_4.K2SO_4$).

AESTHETIC AGENT

An aesthetic agent such as a fragrance and/or colorant is included to indicate to the consumer that cleaning is taking place; preferably both a fragrance and colorant are included. The fragrance may be any compound or composition which imparts an acceptable odor to the water being treated, and may include, for example: essential oils such as lemon oil; extracts such as pine extract; and terpene hydrocarbons such as terpene alcohols and terpene aldehydes and ketones. The fragrance may be a sorbed onto or into a carrier to enable a dry formulation. Typically a silica carrier is used, and mixed with liquid fragrance in a 1:2 ratio of silica to fragrance. A fragrance may be present in an amount of from about 0.1 to 30 percent, preferably 5 to 15 percent.

It is also desirable that the composition include a colorant such as a pigment or dye. Dyes are preferred; examples of suitable dyes include FD & C Blue No. 1, Copper Phthalocyanine, Acid Blue No. 9, Carta Blue V (C.I. 24401), Acid Green 2G (C.I. 42085), Astragon Green D (C.I. 42040), Maxilon Blue 3RL (C.I. Basic Blue 80), Dimarine Blue Z-RL (C.I. Reactive Blue 18) and other Acid Blue 9 type dyes. Colorants, especially dyes, are preferred when formulated as dry powders to enable direct incorporation into the tablet or block, however, liquid colorants may be employed in conjunction with suitable carriers. Colorants may be present in an amount from about 0.1 to 15 percent.

ADJUNCTS

The composition may also include solubility control agents, water-softening agents, germicides, preservatives, flow aids, water-soluable fillers, corrosion inhibitors, and the like.

The toilet cleaning tablet of the present invention is preferably prepared by dry mixing the ingredients. All adjunct materials, except for the liquid fragrance, are also dry mixed in the blend. The fragrance and silica, as a carrier, are premixed and then dry mixed with the blend. If a molding process is used, an external lubricant may be employed to help release the block from the mold.

A preferred manufacturing process is one of extrusion, wherein the ingredients are first blended to provide a homogenous mixture. Any type of mixer such as a twin-shell, ribbon blender or similar type of mixer that is designed to provide a homogeneous admixture can be used. The mix is then transferred to an extruder where heat of friction softens the surfactants and provides additional homogeneity to the blend. The blend is compressed into a uniform extrudate, which is then cut into tablets, preferably ranging in weight from about 30 to about 100 grams.

EXPERIMENTAL

Testing was performed with seventy gram tablets in toilets that were flushed 10 to 12 times per day. The water temperature was maintained at about 70 degrees Fahrenheit for the duration of the test. The tablets were visually checked for color delivered to the bowl and for tablet remaining in the tank, and fragrance (or absence thereof) was noted. Results are shown in Table I below.

TABLE I

| | Floating Residue | Undissolved Tablet | Color | Fragrance |
|---|---|---|---|---|
| Composition A | | | | |
| 1 week | No | Yes | Yes | Yes |
| 2 weeks | No | Yes | Yes | Yes |
| 3 weeks | No | Yes | Yes | Yes |
| 4 weeks | No | Yes | Yes | Yes |
| 5 weeks | No | No | No | No |
| Composition B | | | | |
| 1 week | No | Yes | Yes | Yes |
| 2 weeks | No | Yes | Yes | Yes |
| 3 weeks | No | Yes | Yes | Yes |
| 4 weeks | No | Yes | Yes | Yes |
| 5 weeks | No | Yes | Yes | Yes |

Compositions A and B are both within the scope of the present invention and comprise:

| | Weight Percent | |
|---|---|---|
| Component | A | B |
| Sodium lauryl sulfate | 9.0 | 9.0 |
| Linear Alkyl Benzene Sulfonate | 12.0 | 12.0 |
| Cocomonoethanolamide | 9.0 | 11.5 |
| Hydroxethylcellulose | 15.0 | 15.0 |
| Sodium citrate | 12.0 | 9.5 |

In addition, A and B each contain 10% sodium carbonate, 7% sodium monopersulfate and 16% dye/silica blend. Composition A was formulated to have a four week useful life, while Composition B was formulated to have a twelve-week useful life.

It can be seen from the data of Table I that floating residue (loose undissolved tablet constituents) is eliminated, even after five weeks of use. Furthermore, in all trials, the presence of aesthetic agents (color and fragrance) correlated perfectly with continued tablet presence and activity. At the end of five weeks, composition A was fully dissolved, leaving neither residue nor aesthetic agent. In general, higher levels of dissolution control agent increase residue, but higher levels of dissolution control agent coupled with binder slow the dissolution of the tablet. Higher levels of surfactant(s), or lower levels of dissolution control agent or binder speed dissolution of the tablet.

What is claimed is:

1. A method of making a composite cleaning block, providing substantially complete and uniform dissolution of all components, comprising the steps of:

(a) forming a preblend by dry blending an alkyl sulfate surfactant, a dissolution control agent, a binder, a linear alkyl sulfonate surfactant, and any adjuncts;

(b) forming a fragrance premix, comprising a fragrance and a silica carrier;

(c) mixing the preblend and premix, to result in a substantially uniform mixture; and (d) extruding the resultant composition into tablet form.

* * * * *